US012037690B2

(12) United States Patent
Westre et al.

(10) Patent No.: US 12,037,690 B2
(45) Date of Patent: Jul. 16, 2024

(54) CONVERSION COATING APPLICATION SYSTEM INCLUDING HYDROGELS AND METHODS OF USING SAME

(71) Applicant: Chemeon Surface Technology, LLC, Minden, NV (US)

(72) Inventors: Alexander Evan Westre, Carson City, NV (US); Sjon Westre, Carson City, NV (US)

(73) Assignee: Chemeon Surface Technology, LLC, Minden, NV (US)

( * ) Notice: Subject to any disclaimer, the term of this patent is extended or adjusted under 35 U.S.C. 154(b) by 0 days.

(21) Appl. No.: 18/209,123

(22) Filed: Jun. 13, 2023

(65) Prior Publication Data

US 2023/0399751 A1 Dec. 14, 2023

Related U.S. Application Data

(60) Provisional application No. 63/351,771, filed on Jun. 13, 2022.

(51) Int. Cl.

| | |
|---|---|
| ***C23C 22/30*** | (2006.01) |
| ***C23C 22/53*** | (2006.01) |
| ***C23C 22/56*** | (2006.01) |
| ***C23C 22/57*** | (2006.01) |
| ***C23C 22/73*** | (2006.01) |
| *C23C 22/48* | (2006.01) |

(52) U.S. Cl.

CPC ..... *C23C 22/57* (2013.01); *C23C 22/53* (2013.01); *C23C 22/56* (2013.01); *C23C 22/73* (2013.01)

(58) Field of Classification Search

CPC ..... C23C 2222/10

See application file for complete search history.

(56) References Cited

U.S. PATENT DOCUMENTS

2014/0124099 A1 5/2014 Inoue et al.
2020/0141005 A1 5/2020 Westre et al.

FOREIGN PATENT DOCUMENTS

CN 108841318 11/2019

OTHER PUBLICATIONS

International Search Report and Written Opinion of The International Searching Authority for International Application PCT/US23/25199, mailed Sep. 21, 2023.

Minting et al. "Preparation of vancomycin-loaded alginate hydrogel coating on magnesium alloy with enhanced anticorrosion and antibacterial properties "Thin Solid Films, vol. 693 Article 137679 (Oct. 31, 2019); pp. 1-7; entire document, but especially; abstract, fig, 1, table 2.

Selvi et al. "Effect of nano-zerovalent iron incorporated polyvinal-alginate hybrid hydrogel matrix of inhibition of corrosive bateria in a colling tower water environment" SN Applied Sciences, vol. 1, Article 424 (Apr. 6, 2019); pp. 1-9; entire document.

*Primary Examiner* — Lois L Zheng

(74) *Attorney, Agent, or Firm* — Holland & Hart LLP

(57) ABSTRACT

A conversion coating applicator includes a first liner, a hydrogel attached to the first liner, and a second liner removably attached to the hydrogel. The hydrogel includes a trivalent chromium conversion coating solution including a trivalent chromium compound, a zirconate compound, and a dye compound. The conversion coating solution is an aqueous solution.

14 Claims, 8 Drawing Sheets

CONVERSION COATING APPLICATION SYSTEM INCLUDING HYDROGELS AND METHODS OF USING SAME

CROSS REFERENCE TO RELATED APPLICATION

This application claims priority to and the benefit of U.S. Provisional Patent Application No. 63/351,771, filed Jun. 13, 2022, and entitled CONVERSION COATING APPLICATION SYSTEM INCLUDING HYDROGELS AND METHODS OF USING SAME, the disclosure of which is incorporated herein by reference in its entirety.

BACKGROUND OF CERTAIN ASPECTS OF THE DISCLOSURE

Conversion coatings are widely used to treat metal surfaces to improve corrosion resistance, increase adhesion of subsequent coatings such as paint, form a decorative finish, or retain electrical conductivity. Conversion coatings are formed by applying a conversion coating solution to the metal. The conversion coating solution and the metal react to convert or modify the metal surface into a thin film with the desired functional characteristics. Conversion coatings are particularly useful for the surface treatment of metals such as aluminum, zinc, and magnesium.

Metal surfaces may be subject to corrosion or other types of degradation as the metal surfaces are exposed to the elements or other operational conditions. For example, metal pipes in industrial facilities may be exposed to the elements or may be exposed to harsh operating environments that may degrade or corrode the metal surface. Replacing the degraded or corroded metals pipes is costly and often requires the industrial facility to shut down during repairs. Furthermore, applying conversion coatings during operations typically involves manually brushing on the conversion coating with brushes or sprayers that may cause workers to be exposed to chemicals within the conversion coatings. Additionally, the brushes and sprayers typically apply excess conversion coating that may spread to other areas of the industrial facility that were not intended to be coated, requiring extensive clean up. Accordingly, there is a need for a system that applies conversion coatings to metal surfaces that minimizes exposure to the chemicals within the conversion coatings, minimizes the clean up required after the conversion coating has been applied, and reduces costs to apply a conversion coating.

BRIEF SUMMARY OF SOME ASPECTS OF THE DISCLOSURE

A number of embodiments of a chemical applicator that is configured to apply a reactive chemical solution or a reactive chemistry to a surface. The chemical applicators described herein typically include a hydrogel that contains the reactive chemical solution until the hydrogel and the reactive chemical solution contact the surface. The hydrogel enables the reactive chemical solution to contact the surface such that the reactive chemical solution reacts with the surface to complete a desired chemical, physical, and/or mechanical transformation. The hydrogel may be configured to contain any reactive chemistry, including hazardous chemistries, provided the hydrogel does not unfavorably react with the reactive chemistry prior to application on the surface and enables the reactive chemistry to contact and react with the surface. The chemical applicators described herein contain the reactive chemical solution in the hydrogel, apply the reactive chemical solution to the surface such that the reactive chemical solution reacts and/or operates as if the surface had been into the reactive chemical solution, and/or applied the reactive chemical solution in a manner that reduces waste, reduces mess, and reduces exposure to the reactive chemical solution. Contact between the hydrogel and the surface to be coated allows the reaction to take place often without heat or other forms of energy such as mechanical scrubbing.

In the embodiments described herein, the reactive chemical solution typically includes a conversion coating solution that can be used to form such conversion coatings are disclosed. The conversion coating solution broadly includes trivalent chromium, hexavalent chromium, and/or non-hexavalent chromium compounds and the conversion coating applicator also broadly includes a hydrogel configured to selectively contain the conversion coating solution. In some embodiments, the conversion coating solution includes a chromium compound, a dye compound, and a zirconate compound. Methods for using the conversion coating applicator to protect metal substrates are also disclosed.

The conversion coating solution is used to form a protective coating on a metal substrate and the conversion coating applicator is used to apply the conversion coating solution to the metal substrate. The coating generally passivates the metal surface or, in other words, makes it less susceptible to corrosion and/or other undesirable reactions in the future.

The chromium compound can be any suitable chromium compound. One example of a suitable chromium compound is trivalent chromium sulfate. It should be appreciated that other chromium compounds can also be used.

Conversion coatings may be formed on the surface of metals through the use of hydrogels that have been infused with a conversion coating solution. The conversion coating solution is infused into the hydrogel. The conversion coating may then be formed on the metal substrate by placing the hydrogel on the surface of the metal substrate for a period of time, allowing the conversion coating solution to diffuse out of the hydrogel, onto the surface, react, and form the conversion coating.

The conversion coating applicator is easy to use and minimizes cleanup. A hydrogel infused with an active substance is easy to handle and use. It eliminates the need for liquid containers of the conversion coating, reduces or eliminates chemicals running off (dripping off) the surface. The system is applicable to preparatory chemistries as well—cleaners, activators, etc., so that the application and ultimate formation of the coating does not waste chemicals and improves the safety of forming the coating because the materials are relatively contained and minimize the chance that the chemistry will spill on the user.

There are other novel aspects and features of this disclosure. They will become apparent as this specification proceeds. Accordingly, this brief summary is provided to introduce a selection of concepts in a simplified form that are further described below in the detailed description. The summary and the background are not intended to identify key concepts or essential aspects of the disclosed subject matter, nor should they be used to constrict or limit the scope of the claims. For example, the scope of the claims should not be limited based on whether the recited subject matter includes any or all aspects noted in the summary and/or addresses any of the issues noted in the background.

DRAWINGS

The preferred and other embodiments are disclosed in association with the accompanying drawings in which.

DETAILED DESCRIPTION

Figure 1:
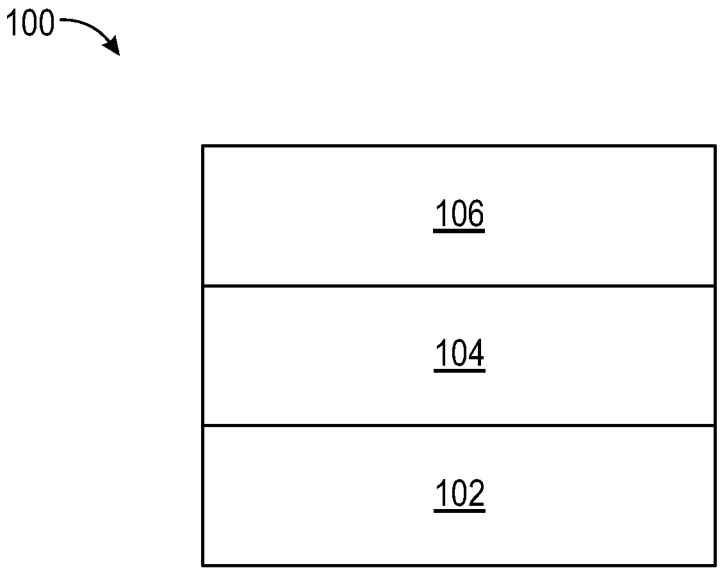
FIG. 1 illustrates a side schematic view of a conversion coating applicator in accordance with aspects of the present disclosure.

A number of embodiments of a reactive chemical applicator or a conversion coating applicator are disclosed along with hydrogels, conversion coatings, and additives that can be used to form the conversion coating applicator and methods for treating a substrate with the conversion coating applicator. In general, the conversion coating applicator includes a hydrogel infused with a reactive chemical solution. In the illustrated embodiments, the reactive chemical solution includes a conversion coating solution. In alternative embodiments, the reactive chemical solution may be any chemical solution that enables the conversion coating applicator to operate as described herein. The hydrogel enables the conversion coating solution to be applied to a limited area of the substrate such that only the limited area of the substrate contacts the conversion coating solution, minimizing contamination of other areas and minimizing worker contamination. The conversion coating solution may include a trivalent chromium compound, a hexavalent chromium compound, a non-hexavalent chromium compound, a zirconate compound, and/or a dye compound. The conversion coating solution may be used to improve the metal's corrosion resistance, abrasive properties, and adhesion bonding properties as well as dye a metal surface or part.

The conversion coating applicator may provide one or more of the following improvements/advantages over conventional application systems: 1) simpler and easier application that reduces the amount of training required for a worker to safely apply the conversion coating to a substrate, 2) limited application area that reduces excess conversion coating solution application and conversion coating solution waste, 3) reduced cleanup, and/or 4) reduced exposure of workers to the conversion coating solution.

Hydrogels

Hydrogel typically include three-dimensional networks of hydrophilic polymers that swell in water and contain a large amount of water relative to their volume while maintaining the structure due to chemical or physical cross-linking of individual polymer chains. Hydrogels typically include at least 10% water of the total weight (or volume), are hydrophilic, and are flexible such that hydrogels can conform to the shape of a surface they are positioned on. The hydrophilicity of the network is due to the presence of hydrophilic groups such as —NH2, —COOH, —OH, —CONH2, —CONH—, and —SO3H.

Hydrogels typically may undergo a volume phase transition or gel-sol phase transition in response to certain physical and chemical stimuli. The physical stimuli may include temperature, electric and magnetic fields, solvent composition, light intensity, and pressure, and the chemical stimuli may include chemical reactions, pH, ions, and specific chemical compositions. Most conformational transitions are reversible, and the hydrogels are capable of returning to their initial state after a reaction as soon as the trigger is removed. The response of hydrogels to external stimuli is typically determined by the nature of the monomer, charge density, pendant chains, and the degree of cross-linkage. The magnitude of response is also typically directly proportional to the applied external stimulus.

FIG. 1 illustrates a side schematic view of a conversion coating applicator 100 in accordance with aspects of the present disclosure. The conversion coating applicator 100 includes a first liner 102, a hydrogel 104, and a second liner or cover 106. In addition, the conversion coating applicator 100 may include additional layers not illustrated in FIG. 1. For example, the hydrogel 104 may include a plurality of hydrogel layers to absorb and deposit a plurality of conversion coating chemicals. Additionally, the first liner 102 and the second liner 106 may also include plurality of layers configured for strength, moisture retention, and adhesion such as, but not limited to, a scrim and/or a non-woven scrim. The scrim and/or the non-woven scrim may be part of the first liner 102, the hydrogel 104, and/or the second liner or cover 106 to provide additional support for the conversion coating applicator 100.

The first liner 102 is configured to hold and maintain the hydrogel 104 in place. The first liner 102 includes an inert plastic or polymer that does not absorb the hydrogel or the conversion coating chemicals. The first liner 102 is flexible but strong enough to hold the hydrogel and withstand the elements for short durations while the conversion coating chemicals react with the metal substrate. As such, the first liner 102 may include any material that is strong enough to hold the hydrogel 104, flexible enough to apply the hydrogel over a metal substrate, resistant to absorption of the conversion chemicals, and inert to the conversion coating solution. In the illustrated embodiment, the first liner 102 may include polyethylene, polyester, polypropylene, polyethylene terephthalate, medium-density polyethylene, and/or polytetrafluoroethylene.

Similarly, the second liner 106 is also configured to hold and maintain the hydrogel 104 in place. However, the second liner 106 is configured to be removed from the hydrogel 104 prior to application of the hydrogel 104 to the metal substrate. The second liner 106 also includes an inert plastic or polymer that does not absorb the hydrogel or the conversion coating chemicals. Typically, the second liner 106 is also flexible but strong enough to hold the hydrogel and withstand the elements for short durations. As such, the second liner 106 may include any material that is strong enough to hold the hydrogel 104 and resistant to absorption of the conversion chemicals. In some embodiments, the second liner 106 may include the same material as the first liner 102. In the illustrated embodiment, the second liner 106 may include polyethylene, polyester, polypropylene, polyethylene terephthalate, medium-density polyethylene, and/or polytetrafluoroethylene.

The hydrogel 104 includes a polymer hydrogel that is configured to: (1) absorb the conversion chemicals, (2) desorb the conversion chemicals when the hydrogel 104 contacts a metal substrate, and (3) is inert with respect to the conversion chemicals. As such, the hydrogel 104 may include any network of hydrophilic polymers that can swell and hold the conversion chemicals.

For example, the hydrogel 104 may include any of the following hydrogel types: homopolymeric hydrogels, cationic hydrogels, natural hydrogels, physically cross linked hydrogels, amorphous hydrogels, copolymeric hydrogels, anionic hydrogels, synthetic hydrogels, chemically cross linked hydrogels, semicrystalline hydrogels, interpenetrating hydrogels, nonionic hydrogels, hybrid hydrogels, crystalline hydrogels, hydrocolloid aggregate hydrogels, and/or any other type of hydrogel. If the hydrogel is a synthetic hydrogel, the hydrogel 104 may include poly(vinyl alcohol), polyethylene oxide, poly(acrylic acid), poly(hydroxyethyl methacrylate), poly(glyceryl methacrylate), poly(hydroxypropyl methacrylate), polyacrylamide, poly(ethylene glycol), poly(vinylpyrrolidone), poly(ethyleneimine), polyhydric alcohol, polyacrylamide, polysaccharide, and/or any other type of polymer. If the hydrogel 104 includes a natural hydrogel, the hydrogel 104 may include chitosan, alginate, collagen, silk fibroin, hyaluronic acid, fibrin, gelatin, agarose, and/or any other type of natural hydrogel. The hydrogel 104 may include some commercially available hydrogels including Actiformcool®, Aquaflo®, Clearsite®, Geliperm®, Hydrosorb®, Novogel®, Primskin®, Suprasorb G®, AquaDerm®, Tegraderm®, and/or any other commercially available hydrogel.

As described herein, the conversion coating applicator 100 is configured to hold the conversion coating solution until the second liner 106 has been removed and the hydrogel 104 contacts a metal substrate. The conversion coating solution then reacts with the metal substrate, diffuses toward the metal substrate as the reaction consumes the conversion coating solution, and desorbs from the hydrogel 104 onto the metal substrate to react with the metal substrate.

Chromium Compound

In the illustrated embodiment, the reactive chemical solution includes a chromium compound for forming a conversion coating on the metal substrate. The chromium compound may be any type of chromium compound including, but not limited to, a trivalent chromium compound, a hexavalent chromium compound, and a non-hexavalent chromium compound. In alternative embodiments, the reactive chemical solution may include a non-chromium compound that is capable of forming a conversion coating on the metal substrate. More specifically, in the illustrated embodiment and in the Examples described herein, the reactive chemical solution includes a trivalent chromium compound.

The trivalent chromium compound can be any suitable trivalent chromium compound capable of forming a conversion coating on the metal substrate. Examples of suitable trivalent chromium compounds can be found in the patents incorporated by reference at the end of the description.

The trivalent chromium compound can be a water-soluble trivalent chromium compound such as a trivalent chromium salt. It is generally desirable to use chromium salts that provide anions that are not as corrosive as chlorides. Examples of such anions include nitrates, sulfates, phosphates, and acetates. In a preferred embodiment, the trivalent chromium compound is a trivalent chromium sulfate. Examples of such compounds include $Cr_2(SO_4)_3$, $(NH_4)Cr(SO_4)_2$, or $KCr(SO_4)_2$.

It should be appreciated that the conversion coating solution can include one or multiple trivalent chromium compounds. For example, in one embodiment, the conversion coating solution includes a single trivalent chromium compound. In another embodiment, the conversion coating solution includes two, three, four, or more trivalent chromium compounds.

The conversion coating solution can include any suitable quantity of the trivalent chromium compound. Examples of suitable quantities can be found in the patents incorporated by reference at the end of the description. In some embodiments, the conversion coating solution includes approximately 0.1 g/liter (0.01 wt %) to approximately 20 g/liter (2 wt %) of the trivalent chromium compound, approximately 0.2 g/liter (0.02 wt %) to approximately 10 g/liter (1 wt %) of the trivalent chromium compound, or approximately 0.5 g/liter (0.05 wt %) to approximately 8 g/liter (0.8 wt %) of the trivalent chromium compound.

In other embodiments, the conversion coating solution includes at least approximately g/liter (0.01 wt %) of the trivalent chromium compound, at least approximately 0.2 g/liter (0.02 wt %) of the trivalent chromium compound, or at least approximately 0.5 g/liter (0.05 wt %) of the trivalent chromium compound. In still other embodiments, the conversion coating solution includes no more than 20 g/liter (2 wt %) of the trivalent chromium compound, no more than 10 g/liter (1 wt %) of the trivalent chromium compound, or no more than 8 g/liter (0.8 wt %) of the trivalent chromium compound.

Dye Compound

The dye compound (alternatively referred to as a pigment compound or colorant compound) can be any material that is compatible with the conversion coating solution and the hydrogel chemistry and is capable of imparting a color to the metal substrate. In some embodiments, the dye compound includes one or more metal atoms and in other embodiments it does not. In those embodiments where the dye compound includes one or more metal atoms, the metal atom can be present as part of a metal complex.

In some embodiments, the dye compound can include an azo dye, a chromium complex dye, an anthraquinoid dye, and/or a methine dye. In a preferred embodiment, the dye compound includes a metal complex azo dye, a chromium complex dye, and/or metal free azo dye. It should be appreciated that azo dyes include monoazo dyes, disazo dyes, and/or trisazos dyes.

Numerous other dye compounds can be used as long as they are compatible with the other constituents in the conversion coating solution and the hydrogel. Examples of such dyes include those used to anodize aluminum and colorize textiles. Other examples include acid dyes, mordant dyes, metal-complex dyes, triphenylmethane dyes, xanthene dyes, wool dyes, silk dyes, direct dyes, reactive dyes, vat dyes, and the like. It is understood that these dyes may be classified in more than one way such as by structure or by typical use—e.g., a dye may be referred to as a chrome dye, a mordant dye, a wool dye, etc.

It should be appreciated that the conversion coating solution can include one or multiple dye compounds including any quantity and/or combination of the dyes described above. In some embodiments, the trivalent chromium conversion coating solution comprises approximately 0.1 g/liter (0.01 wt %) to approximately 20 g/liter (2 wt %) of the dye compound, approximately 0.2 g/liter (0.02 wt %) to approximately 10 g/liter (1 wt %) of the dye compound, or approximately 0.5 g/liter (0.05 wt %) to approximately 5 g/liter (0.5 wt %).

In some other embodiments, the conversion coating solution comprises at least approximately 0.1 g/liter (0.01 wt %) of the dye compound, at least approximately 0.2 g/liter (0.02 wt %) of the dye compound, or at least approximately 0.5 g/liter (0.05 wt %) of the dye compound. In yet other embodiments, the conversion coating solution comprises no more than g/liter (2 wt %) of the dye compound, no more than 10 g/liter (1 wt %) of the dye compound, or no more than 5 g/liter (0.5 wt %) of the dye compound.

Zirconate Compound

The zirconate compound can be any suitable zirconate compound that is capable of facilitating the formation of a protective coating on a substrate. Examples of suitable zirconate compounds include alkali metal hexafluorozirconate compounds such as potassium hexafluorozirconate, sodium hexafluorozirconate, and fluorozirconic acid.

In some embodiments, the conversion coating solution comprises approximately 0.2 g/liter (0.02 wt %) to approximately 20 g/liter (2 wt %) of the zirconate compound, approximately g/liter (0.05 wt %) to approximately 18 g/liter (1.8 wt %) of the zirconate compound, or approximately 1 g/liter (0.1 wt %) to approximately 15 g/liter (1.5 wt %) of the zirconate compound.

In some other embodiments, the conversion coating solution comprises at least approximately 0.2 g/liter (0.02 wt %) of the zirconate compound, at least approximately 0.5 g/liter (0.05 wt %) of the zirconate compound, or at least approximately 1 g/liter (0.1 wt %) of the zirconate compound. In yet other embodiments, the conversion coating solution comprises no more than approximately 20 g/liter (2 wt %) of the zirconate compound, no more than approximately 18.0 g/liter (1.8 wt %) of the zirconate compound, or no more than approximately g/liter (1.5 wt %) of the zirconate compound.

Other Compounds

The trivalent chromium conversion coating solution can include a variety of additional compounds. Examples of additional compounds can be found in the patents incorporated by reference at the end of the description. Any individual compound or combination of compounds disclosed in the patents can be included in the conversion coating solution in any of the disclosed quantities.

In some embodiments, the trivalent chromium conversion coating solution includes a phosphorous compound that further enhances corrosion protection of the metal substrate. The improved corrosion protection is provided by adsorption of phosphonate groups from an organic amino-phosphonic acid compound on a surface of the metal substrate to form a M-O—P covalent bond and subsequent formation of a network hydrophobic layer over any active corrosion site on the metal substrate.

Examples of suitable phosphorous compounds include derivatives of amino-phosphonic acids such as the salts and esters of nitrilotris(methylene)triphosphonic acid (NTMP), hydroxy-, amino-alkylphosphonic acids, ethylimido(methylene)phosphonic acids, diethylaminomethylphosphonic acid, and the like. Preferably, the derivative is soluble in water. A particularly suitable phosphorous compound for use as a corrosion inhibitor and solution stabilizer is nitrilotris (methylene)triphosphonic acid (NTMP).

The phosphorous compound can be present in the conversion coating solution in any suitable amount. In some embodiments, the conversion coating solution comprises approximately 5 ppm to approximately 100 ppm of the phosphorous compound or approximately ppm to approximately 30 ppm of the phosphorous compound. In other embodiments, the conversion coating solution comprises at least approximately 5 ppm of the phosphorous compound or at least approximately 10 ppm of the phosphorous compound. In still other embodiments, the conversion coating solution comprises no more than approximately 100 ppm of the phosphorous compound or no more than 30 ppm of the phosphorous compound.

The trivalent chromium conversion coating solution can also comprise a fluoride compound. Examples of suitable fluoride compounds include alkali metal tetrafluoroborates (e.g., potassium tetrafluoroborate), alkali metal hexafluorosilicates (e.g., potassium hexafluorosilicate), and the like. The fluoride compound is preferably water soluble.

The fluoride compound can be present in the conversion coating solution in any suitable amount. In some embodiments, the conversion coating solution comprises approximately 0.2 g/liter (0.02 wt %) to approximately 20 g/liter (2 wt %) of the fluoride compound or approximately 0.5 g/liter (0.05 wt %) to approximately 18 g/liter (1.8 wt %) of the fluoride compound. In other embodiments, the trivalent chromium conversion coating solution comprises at least approximately 0.2 g/liter (0.02 wt %) of the fluoride compound or at least approximately 0.5 g/liter (0.05 wt %) of the fluoride compound. In still other embodiments, the trivalent chromium conversion coating solution comprises no more than 20 g/liter (2 wt %) of the fluoride compound or no more than 18 g/liter (1.8 wt %) of the fluoride compound.

In some embodiments, the trivalent chromium conversion coating solution includes a corrosion inhibitor additive that increases the corrosion resistance provided by the coating. Examples of suitable corrosion inhibitor compounds include any of those disclosed in CN 102888138. Other examples include 2-mercaptobenzothiazole (MBT), 2-mercaptobenzimidazole (MBI), 2-mercaptobenzoxazole (MBO) and/or benzotriazole (BTA). The addition of the corrosion inhibitor compound can increase the corrosion resistance of the coating so that it satisfies the requirements of MIL-DTL-81706B Class 1A and Class 3 or the less stringent requirements of MIL-DTL-5541F Class 1A and Class 3.

It should be appreciated that although the corrosion inhibitor additive serves to substantially increase the coating's corrosion resistance, the coating can also satisfy the MIL corrosion resistance requirements even in the absence of such an additive.

The trivalent chromium conversion coating solution can also include other materials such as thickeners, surfactants, and the like. Examples of these materials can be found in the patents incorporated by reference at the end of the description. These materials can be included in the trivalent chromium conversion coating solution in any of the quantities disclosed in the patents.

Impurities

Certain impurities can reduce the corrosion resistance/color vibrance of the trivalent chromium conversion coating solution. One example of such an impurity is iron (Fe). Iron impurities present in the dye may reduce the effectiveness so the coating. For example, dye containing 0 ppm of iron can produce test plates (aluminum) that show no corrosion for 800+ hours. However, dye containing 10 ppm of iron can produce plates (aluminum) that show no corrosion for 216 hours. The corrosion resistance of the latter can be increased by adjusting other parameters of the solution such as the chromium content and/or corrosion inhibitor content, but the result is still not as good as those situations where the dye contains 0 ppm of iron.

In some embodiments, the dye and/or the trivalent chromium conversion coating solution have no more than 100 ppm iron, no more than 50 ppm iron, no more than 25 ppm iron, no more than 10 ppm iron, no more than 5 ppm iron, no more than 2 ppm iron, no more than 1 ppm iron, or, preferably, no iron. The dye and/or the trivalent chromium conversion coating solution can have 0-100 ppm iron.

In some embodiments, the trivalent chromium conversion coating solution has no more than 750 ppb iron, no more than 500 ppb iron, no more than 300 ppb iron, no more than 100 ppb iron, no more than 50 ppb iron, or, preferably no iron.

Conversion Coating Solution Formation

The conversion coating solution can take a variety of forms. In some embodiments, the conversion coating solution is the final mixed solution having the concentrations of the various compounds described above. A typical example of a final mixed solution includes one part trivalent chromium conversion coating solution concentrate, one part dye additive, and two parts water. The final mixed solution is then absorbed into the hydrogel as described herein and the conversion coating applicator 100 can be sold as an already mixed ready to use product.

The trivalent chromium conversion coating solution can be used to treat any suitable metal substrate. In some embodiments, the trivalent chromium conversion coating solution can be used to treat substrates comprising aluminum, magnesium, and/or zinc. The substrates can be pure or commercially pure aluminum, magnesium, or zinc. The substrates can also be an alloy of these metals or an alloy that includes these metals.

In other embodiments, the conversion coating solution can be used to treat substrates comprising valve metals such as vanadium, tantalum, hafnium, niobium, and/or titanium. The substrates can be a pure or commercially pure elemental valve metal. The substrates can also be an alloy of a valve metal or an alloy that includes a valve metal.

The metal substrate can be subjected to another treatment prior to being treated with the conversion coating solution. For example, the metal substrate can be anodized before being treated with the conversion coating solution.

The metal substrate can take a variety of forms. In some embodiments, the metal substrate is one or more surfaces of a larger metal part or assembly. For example, the metal substrate may be an exposed metal surface of an aircraft. In other embodiments, the metal substrate is a single part that can be made from a monolithic block of metal or from coupling multiple metal components together.

Preparatory Chemicals in the Conversion Coating Applicator

In some embodiments, the hydrogel 104 may include preparatory chemicals rather than the conversion coating solution. That is, a conversion coating system may include a plurality of conversion coating applicators with different chemicals infused in the hydrogels for different stages of the conversion coating process. For example, the conversion coating process may include the steps of: (a) cleaning the metal substrate prior to application of the conversion coating on the metal substrate, (b) activating the metal substrate prior to application of the conversion coating on the metal substrate, and (c) cleaning the metal substrate after application of the conversion coating on the metal substrate. The hydrogel 104 may include cleaners, activators, desmutters, and/or deoxidizers that may prepare a metal substrate prior to the conversion coating process. Specifically, the cleaners, activators, desmutters, and/or deoxidizers maybe absorbed into the hydrogel 104 and desorbed from the hydrogel 104 onto the metal substrate prior to the conversion coating process.

Generally, to form a conversion coating on the surface of aluminum, the surface is prepared either mechanically or chemically to remove soils and oxides that might inhibit the coating chemistry. Mechanical preparation typically includes solvent wipe followed by mechanical abrasion with an abrasive pad. Chemical preparation typically includes cleaning and activation. Some cleaners are capable of both cleaning and activation in a single step. The surface to be treated should/must exhibit a "water break free" condition prior to conversion coating. This is effected by cleaning the surface and removal of any loose or adherent oxides from the surface.

Various classes of cleaner may be used including alkaline or acidic cleaners. The cleaners are generally non-etching for aluminum applications, though in some cases an etching cleaner is desired. In manufacturing processes, these cleaners are generally heated up to make them effective. Cold cleaners do not clean well in immersion, spray, or brush processes. Various classes of activators may be used including acidic activators including nitric acid. Additionally, the cleaner and/or activator may include desmutters or deoxidizers. The term "deoxidizer" refers to the solutions ability to remove oxides from the surface. The deoxidizer contains strong oxidizing compounds such as persulfate or peroxide and is usually acidic. The acidic component can may include acids such as sulfuric acid, nitric acid, chromic acid, and hydrofluoric acid. These acids may be used individually or in combination. Fluoride is often added to enhance the removal of silicon and magnesium compounds. Iron in the ferric form is used in some deoxidizers as an oxidizing agent. Other chemical pretreatments include alkaline etching.

Method of Forming the Conversion Coating Applicator

A variety of methods can be used to form the conversion coating applicator. In general, the method can comprise one or more of the steps of: (a) forming the first liner, (b) forming the conversion coating solution, (c) forming the hydrogel on the first liner, (d) infusing the conversion coating solution into the hydrogel, (e) attaching the second liner to the hydrogel, and/or (f) sealing the conversion coating applicator in packaging for storage. In some embodiments, (d) infusing the conversion coating solution into the hydrogel may include dipping the hydrogel and first liner into the conversion coating solution and diffusing the conversion coating solution into the hydrogel. In another embodiment, (d) infusing the conversion coating solution into the hydrogel may include spraying the conversion coating solution onto the hydrogel and first liner and diffusing the conversion coating solution into the hydrogel. In yet another embodiment, (d) infusing the conversion coating solution into the hydrogel may include mixing the conversion coating solution into a polymer prior to (c) forming the hydrogel on the first liner and simultaneously c) forming the hydrogel on the first liner with the conversion coating solution.

Additionally, in some embodiments, the hydrogel may be formed on the first liner in a specific, predetermined geometry. For example, in some embodiments, the metal substrate the conversion coating applicator is to be used on may have a specific shape. In order to reduce waste, the hydrogel may be formed on the first liner such that the hydrogel has a shape that corresponds to the specific shape of the metal substate. The conversion coating applicator is applied to the metal substrate as described herein and the corresponding shapes of the metal substrate and the hydrogel enable the conversion coating applicator to target a specific region of the metal substate and reduce waste. More specifically, as shown in FIGS. 2-8, the hydrogel is capable of forming a sharp edge or line of demarcation on the metal substrate. That is, the conversion coating solution does not bleed onto the metal substrate beyond the hydrogel and shaping the hydrogel to correspond to a shape of a specific region of the metal substrate enables the conversion coating applicator to reduce the amount of conversion coating solution used to form the coatings described herein. Additionally, the hydrogel may be shaped after it has been formed on the first liner. For example, the hydrogel may be cut after formation using a cutting device or method (such as laser trimming, X-Y moving blade cutter, die cut, etc.) to form the hydrogel into the shape that corresponds to the specific shape of a portion of the metal substate.

Method of Forming the Preparatory Conversion Coating Applicator

A variety of methods can be used to form the preparatory conversion coating applicator. In general, the method can comprise one or more of the steps of: (a) forming the first liner, (b) forming the conversion coating solution, (c) forming the hydrogel on the first liner, (d) infusing the preparatory solution into the hydrogel, (e) attaching the second liner to the hydrogel, and/or (f) sealing the preparatory conversion coating applicator in packaging for storage. In some embodiments, (d) infusing the preparatory solution into the hydrogel may include dipping the hydrogel and first liner into the preparatory solution and diffusing the preparatory solution into the hydrogel. In another embodiment, (d) infusing the preparatory solution into the hydrogel may include spraying the preparatory solution onto the hydrogel and first liner and diffusing the preparatory solution into the hydrogel. In yet another embodiment, (d) infusing the preparatory solution into the hydrogel may include mixing the preparatory solution into a polymer prior to (c) forming the hydrogel on the first liner and simultaneously c) forming the hydrogel on the first liner with the preparatory solution.

Method of Treating a Metal Substrate with a Conversion Coating Application System or Applicator A variety of methods can be used to treat the metal substrate with the conversion coating application system or applicator. In general, the method can comprise one or more of the steps of: (a) cleaning the metal substrate, (b) activating the metal substrates, (c) applying the trivalent chromium conversion coating solution to the metal substrate (e.g. applying a conversion coating applicator to the metal substrate), (d) rinsing the conversion coating solution off the metal substrate, and (e) drying the metal substrate (either actively or passively). In some embodiments, (a) cleaning the metal substrate may include applying a cleaning applicator having a cleaning solution in the hydrogel to the metal substrate. In some embodiments, (b) activating the metal substrates may include applying an activator applicator having an activation solution in the hydrogel to the metal substrate. In some embodiments, (d) rinsing the conversion coating solution off the metal substrate may include applying a cleaning applicator having a cleaning solution in the hydrogel to the metal substrate.

It should be noted that because the dye is an integral part of the trivalent chromium conversion coating solution, the process of coating and dye the substrate can be performed in a single step. Many conventional methods for dyeing a metal substrate are two step processes. The first step in such processes is to apply the conversion coating, typically by immersing the substrate in a bath. The second step in such processes is to apply the dye, also typically done by immersion. The instant process can apply the conversion coating and color simultaneously.

EXAMPLES

The following examples are provided to further illustrate the disclosed subject matter. They should not be used to constrict or limit the scope of the claims in any way.

Example 1

A first sample of a metal substrate (aluminum) was coated with a conversion coating solution (CHEMEON eTCP) using the conversion coating applicators described herein. No preparation (solvent, aqueous, or abrasive cleaning) of the metal surface was employed—the surface of the aluminum was left in its as-received condition from the supplier. The conversion coating applicator was formed by dipping a KM50K® hydrogel applicator from Katecho® into a conversion coating solution including a trivalent chromium compound for two minutes. The KM50K® hydrogel applicator from Katecho® acquires a light purple color from the conversion coating solution after 8 minute contact with the surface. The KM50K® hydrogel applicator from Katecho® including the conversion coating solution is placed on 6061 aluminum alloy.

Figure 2:
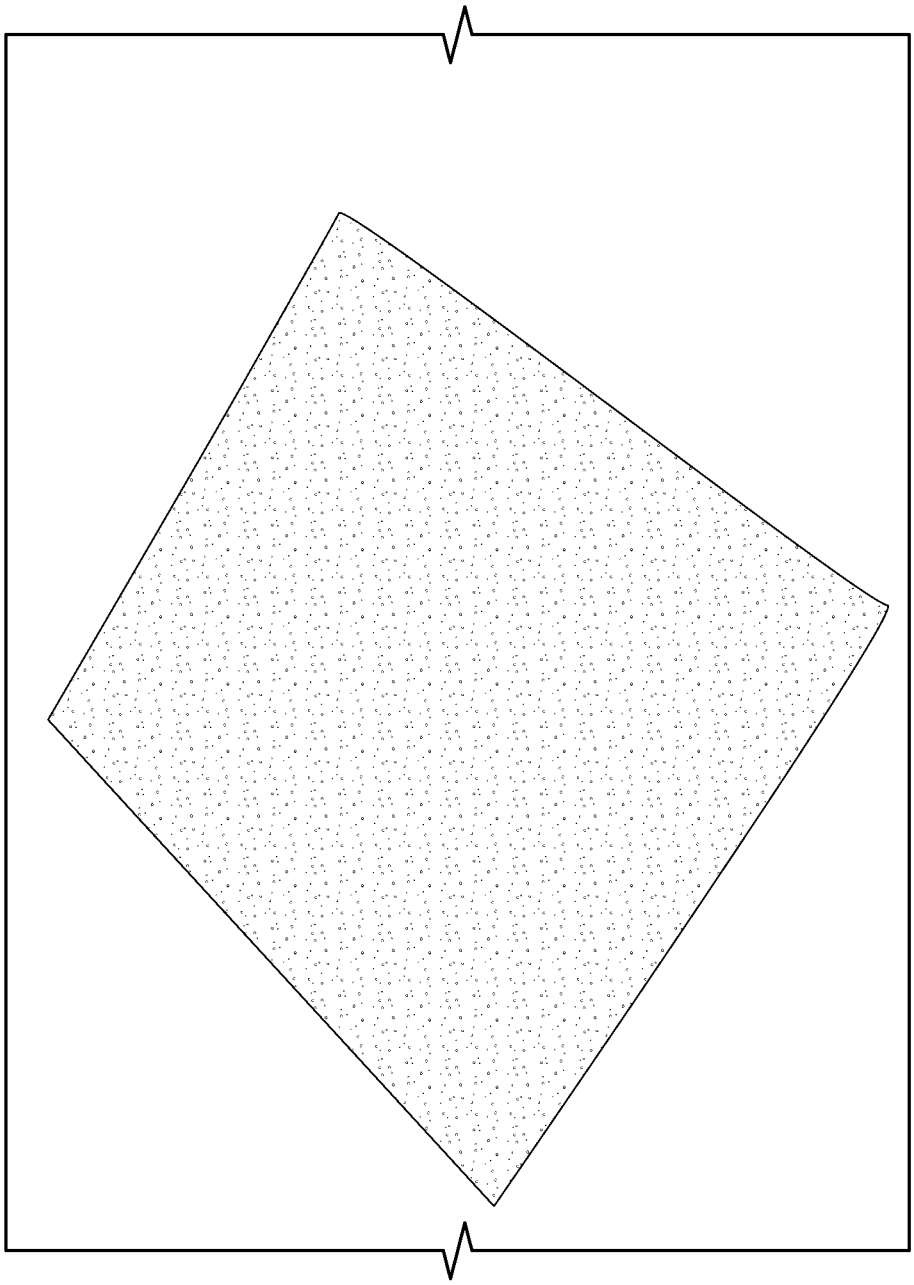
FIG. 2 is a schematic showing a 6061 aluminum alloy with a coating applied by a KM50K® hydrogel applicator from Katecho® including a conversion coating solution.

FIG. 2 is a schematic showing a 6061 aluminum alloy with a coating applied by the KM50K® hydrogel applicator from Katecho® including the conversion coating solution. As shown in FIG. 2, a conversion coating, illustrated as a shaded region on a substrate, is clearly and visibly formed on the 6061 aluminum alloy. Accordingly, the conversion coating applicators described herein are capable of forming conversion coatings that are capable of protecting the 6061 aluminum alloy from degradation.

Example 2

A second sample of a metal substrate (aluminum) was coated with a conversion coating solution (CHEMEON eTCP) using the conversion coating applicators described herein. The conversion coating applicator was formed by dipping a KM50K® hydrogel applicator from Katecho® into a conversion coating solution including an 8 g/L trivalent chromium compound for five minutes. The aluminum substrate was prepared by wiping with isopropanol to remove organic residues on the surface. The KM50K® hydrogel applicator from Katecho® acquires a purple color from the conversion coating solution. The KM50K® hydrogel applicator from Katecho® including the conversion coating solution is placed on 6061 aluminum alloy for eight minutes.

Figure 3:
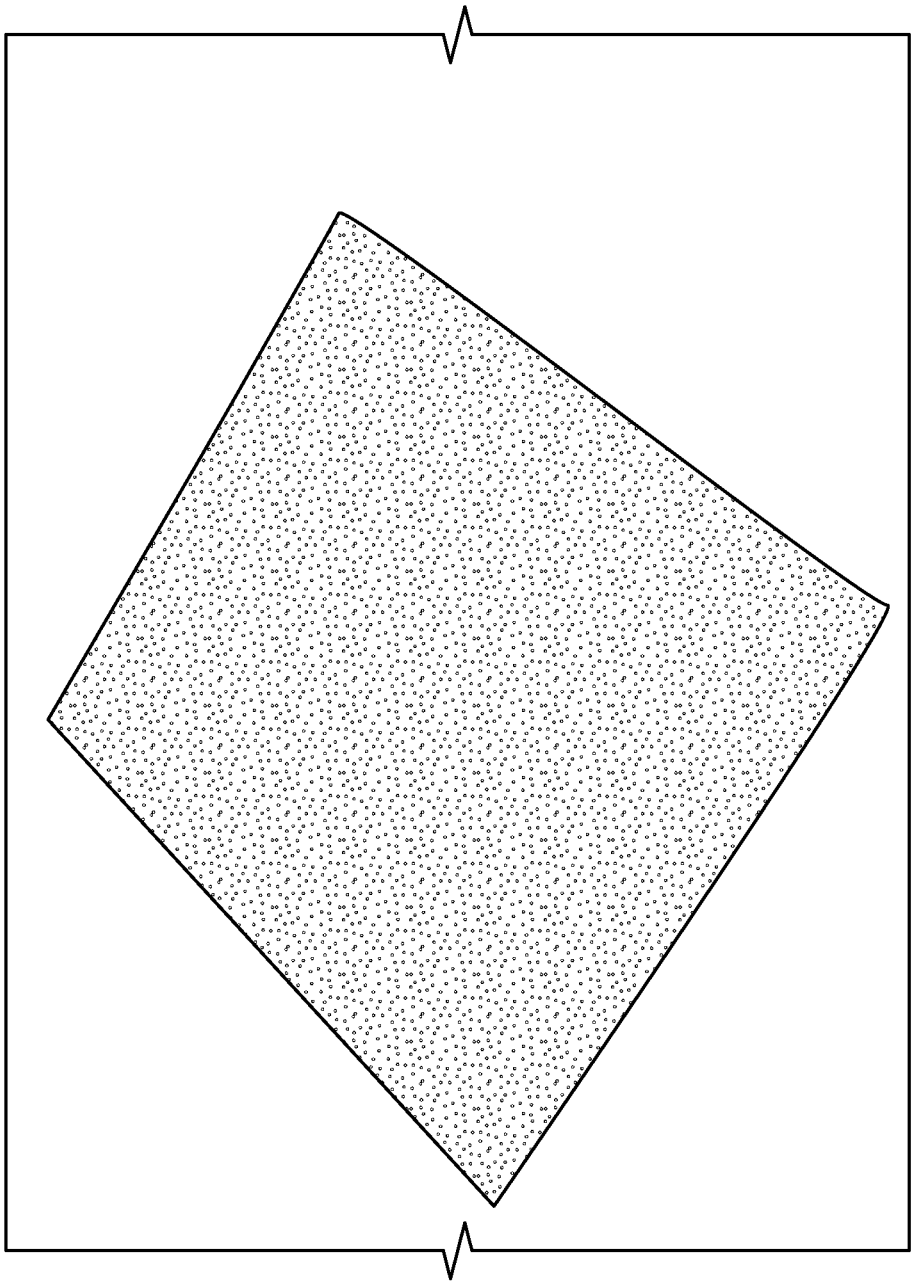
FIG. 3 is another schematic showing a 6061 aluminum alloy with a coating applied by a KM50K® hydrogel applicator from Katecho® including a conversion coating solution.

FIG. 3 is a schematic showing a 6061 aluminum alloy with a coating applied by the KM50K® hydrogel applicator from Katecho® including the conversion coating solution. As shown in FIG. 3, a conversion coating, illustrated as a shaded region on a substrate where the shaded region is darker than the shaded region illustrated in FIG. 2, is clearly and visibly formed on the 6061 aluminum alloy. Accordingly, the conversion coating applicators described herein are capable of forming conversion coatings that are capable of protecting the 6061 aluminum alloy from degradation.

Example 3

A third sample of a metal substrate (aluminum) was coated with a conversion coating solution (CHEMEON eTCP) using the conversion coating applicators described herein. The conversion coating applicator was formed by dipping a KM50K® hydrogel applicator from Katecho® into a conversion coating solution including a 12 g/L trivalent chromium compound for ten minutes. The KM50K® hydrogel applicator from Katecho® acquires a deep purple color from the conversion coating solution. The KM50K® hydrogel applicator from Katecho® including the conversion coating solution is placed on 6061 aluminum alloy for eight minutes. The 6061 alloy aluminum substrate was prepared by first wiping with isopropanol to remove fingerprints and other handling residues, then abrading with an Scotch Brite 07447 pad for roughly 30 seconds, and finally wiping again with isopropanol to remove the abrasive finishing particulates.

Figure 4:
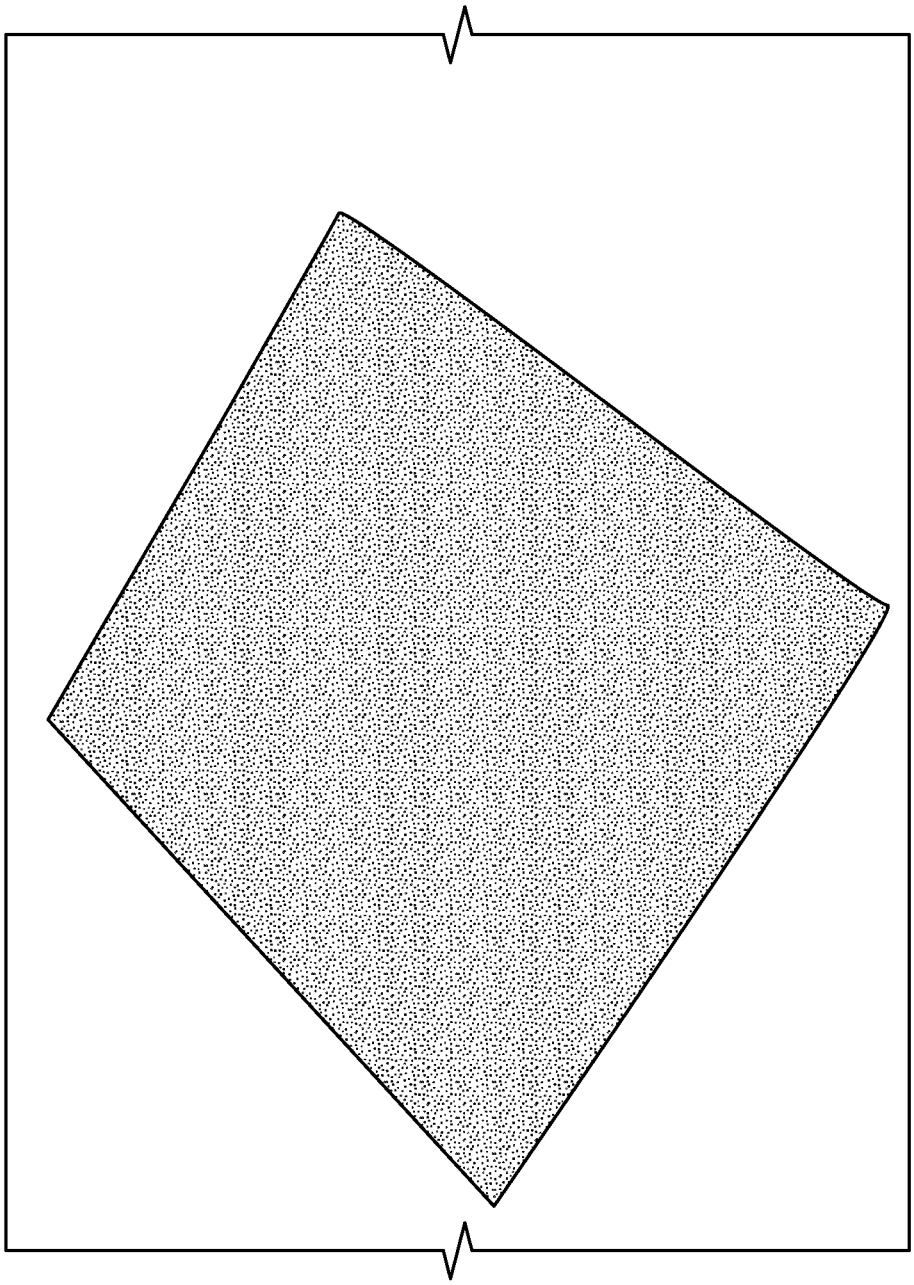
FIG. 4 is another schematic showing a 6061 aluminum alloy with a coating applied by a KM50K® hydrogel applicator from Katecho® including a conversion coating solution.

FIG. 4 is a schematic showing a 6061 aluminum alloy with a coating applied by the KM50K® hydrogel applicator from Katecho® including the conversion coating solution. As shown in FIG. 4, a conversion coating, illustrated as a shaded region on a substrate where the shaded region is darker than the shaded regions illustrated in FIGS. 2 and 3, is clearly and visibly formed on the 6061 aluminum alloy. specifically, the conversion coating has a blue-purple hue on the 6061 aluminum alloy. The edges of the contact area are sharp and distinct. Accordingly, the conversion coating applicators described herein are capable of forming conversion coatings that are capable of protecting the 6061 aluminum alloy from degradation.

Example 4

A fourth sample of a metal substrate (aluminum) was coated with a conversion coating solution (CHEMEON eTCP) using the conversion coating applicators described herein. The conversion coating applicator was formed by dipping a KM50K® hydrogel applicator from Katecho® into a conversion coating solution including a 12 g/L trivalent chromium compound for ten minutes. The KM50K® hydrogel applicator from Katecho® acquires a deep purple color from the conversion coating solution. The KM50K® hydrogel applicator from Katecho® including the conversion coating solution is placed on 6061 aluminum alloy for eight minutes. In Example 4, the KM50K® hydrogel applicator from Katecho® including the conversion coating solution has an area of about 3 inches by 5 inches to test the ability of the KM50K® hydrogel applicator from Katecho® to form conversion coatings over larger areas.

Figure 5:
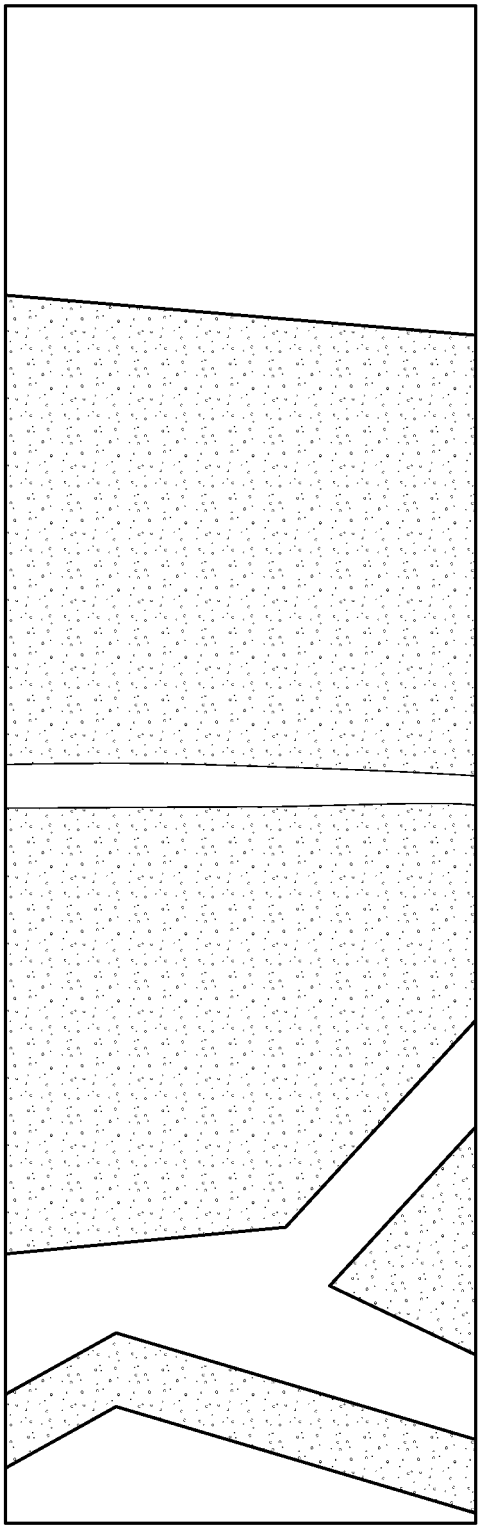
FIG. 5 is another schematic showing a 6061 aluminum alloy with a coating applied by a KM50K® hydrogel applicator from Katecho® including a conversion coating solution.

FIG. 5 is a schematic showing a 6061 aluminum alloy with a coating applied by the KM50K® hydrogel applicator from Katecho® including the conversion coating solution. The hydrogel applicator was prepared by immersing the KM50K into a solution of 12 g/L trivalent chromium conversion coating for 10 minutes at room temperature. The 6061 aluminum substrate was prepared by wiping the surface with acetone followed by isopropanol, mechanically abraded with a Scotch Brite 07447 pad and wiped again with acetone followed by isopropanol. The hydrogel applicator was applied to the prepared aluminum for 8 minutes at room temperature. At the end of the application time, the hydrogel was removed and the aluminum panel was rinsed and dried. As shown in FIG. 5, a conversion coating, illustrated as a shaded region on a substrate, is clearly and visibly formed on the 6061 aluminum alloy. Specifically, the conversion coating has a distinct blue hue on the 6061 aluminum alloy. Light areas of the coated substrate are also coated, though the coating is less in those areas. The areas with less coating are due to wrinkles in the hydrogel applicator. Accordingly, the conversion coating applicators described herein are capable of forming conversion coatings that are capable of protecting the 6061 aluminum alloy from degradation.

Example 5

Figure 6:
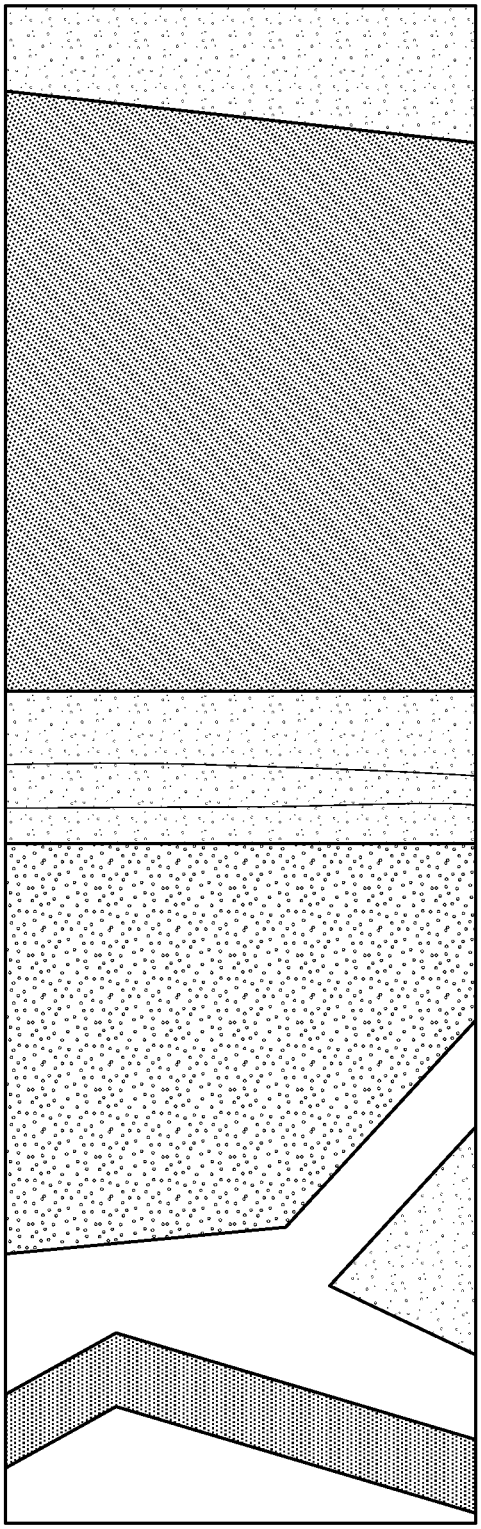
FIG. 6 is a schematic showing the 6061 aluminum alloy from Example 4 after being subjected to a neutral salt spray test.
Figure 7:
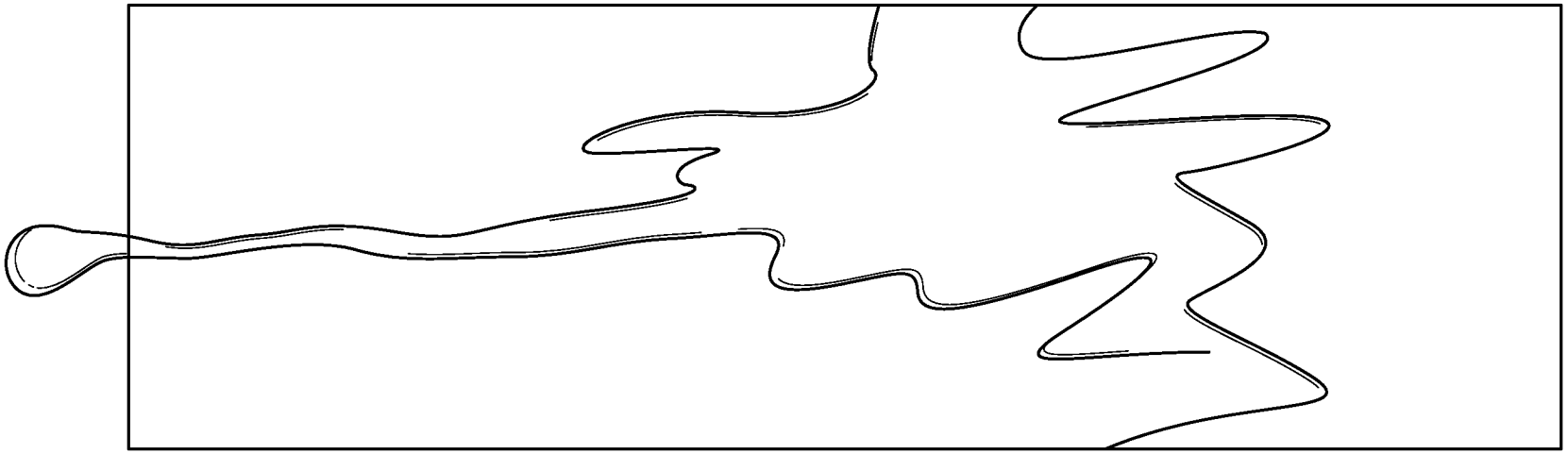
FIG. 7 is a schematic showing a 6061 aluminum alloy after a conversion coating has been applied to the 6061 aluminum alloy and showing that the 6061 aluminum alloy is water break free.

The 6061 aluminum alloy that was coated in Example 4 was subjected to a neutral salt spray test for 528 hours. The test protocol follows ASTM B117 IAW MIL-DTL-5541 and MIL-DTL-81706. FIG. 6 is schematic showing the 6061 aluminum alloy from Example 4 after being subjected to a neutral salt spray test. As shown in FIG. 6, the 6061 aluminum alloy from Example 4 does not experience significant corrosion. Accordingly, the coatings formed by the KM50K® hydrogel applicator from Katecho® including the conversion coating solution protect aluminum alloys from corrosion.

Example 6

A fifth sample of a metal substrate (6061 aluminum alloy) was coated with a cleaning solution using the cleaning applicators described herein. The cleaning applicator was formed by dipping a KM50K® hydrogel applicator from Katecho® into a cleaning solution of 45 g/L Chemeon® Cleaner 1000 ®, an alkaline, borax based cleaner. The KM50K® hydrogel applicator from Katecho® was dipped into the cleaning solution for 20 minutes. The KM50K® hydrogel applicator from Katecho® including the cleaning solution is placed on the upper area of the 6061 aluminum alloy for 25 minutes at room temperature. As shown in in FIG. 7, the KM50K® hydrogel applicator from Katecho® including the cleaning solution produced a water break free surface. The water break free condition demonstrates that the hydrogel infused cleaning applicator effectively cleaned the surface.

Example 7

Figure 8:
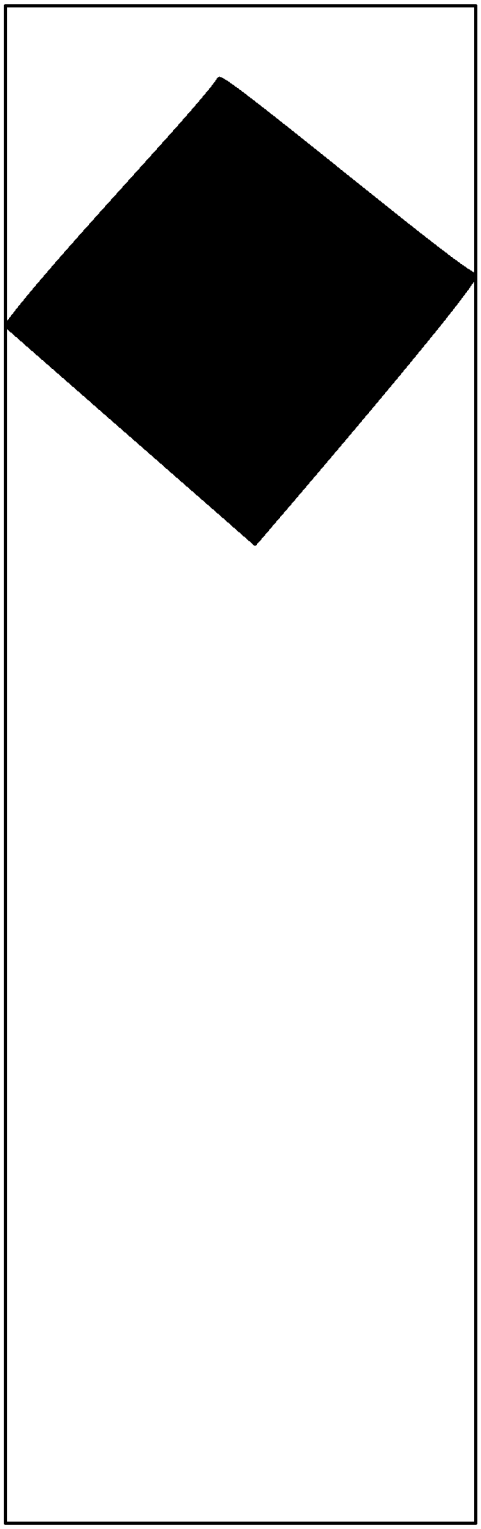
FIG. 8 is another schematic showing a 6061 aluminum alloy with a KM50K® hydrogel applicator from Katecho® including a conversion coating solution applying a coating.

Example applicator showing the Katecho KM50K applicator in use FIG. 8. The applicator was immersed into a solution of 12 g/L CHEMEON eTCP conversion coating, a trivalent chromium conversion coating. The immersion time was 5 minutes. The applicator maintains its shape, adheres well to the surface. The absorbed chemicals do not drip or run, demonstrating that the applicator can target selective areas, minimizes the chemical exposure for the artisans that apply the coatings.

Terminology and Interpretative Conventions

Any methods described in the claims or specification should not be interpreted to require the steps to be performed in a specific order unless stated otherwise. Also, the methods should be interpreted to provide support to perform the recited steps in any order unless stated otherwise.

Spatial or directional terms, such as "left," "right," "front," "back," and the like, relate to the subject matter as it is shown in the drawings. However, it is to be understood that the described subject matter may assume various alternative orientations and, accordingly, such terms are not to be considered as limiting.

Articles such as "the," "a," and "an" can connote the singular or plural. Also, the word "or" when used without a preceding "either" (or other similar language indicating that "or" is unequivocally meant to be exclusive—e.g., only one of x or y, etc.) shall be interpreted to be inclusive (e.g., "x or y" means one or both x or y).

The term "and/or" shall also be interpreted to be inclusive (e.g., "x and/or y" means one or both x or y). In situations where "and/or" or "or" are used as a conjunction for a group of three or more items, the group should be interpreted to include one item alone, all the items together, or any combination or number of the items.

The terms have, having, include, and including should be interpreted to be synonymous with the terms comprise and comprising. The use of these terms should also be understood as disclosing and providing support for narrower alternative embodiments where these terms are replaced by "consisting" or "consisting essentially of."

Unless otherwise indicated, all numbers or expressions, such as those expressing dimensions, physical characteristics, and the like, used in the specification (other than the claims) are understood to be modified in all instances by the term "approximately." At the very least, and not as an attempt to limit the application of the doctrine of equivalents to the claims, each numerical parameter recited in the specification or claims which is modified by the term "approximately" should be construed in light of the number of recited significant digits and by applying ordinary rounding techniques.

All disclosed ranges are to be understood to encompass and provide support for claims that recite any and all subranges or any and all individual values subsumed by each range. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

All disclosed numerical values are to be understood as being variable from 0-100% in either direction and thus provide support for claims that recite such values or any and all ranges or subranges that can be formed by such values. For example, a stated numerical value of 8 should be understood to vary from 0 to 16 (100% in either direction) and provide support for claims that recite the range itself (e.g., 0 to 16), any subrange within the range (e.g., 2 to 12.5) or any individual value within that range (e.g., 15.2).

The terms recited in the claims should be given their ordinary and customary meaning as determined by reference to relevant entries in widely used general dictionaries and/or relevant technical dictionaries, commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used in a manner that is more expansive than its ordinary and customary meaning, the term should be given its ordinary and customary meaning plus the additional expansive meaning, or (b) if a term has been explicitly defined to have a different meaning by reciting the term followed by the phrase "as used in this document shall mean" or similar language (e.g., "this term means," "this term is defined as," "for the purposes of this disclosure this term shall mean," etc.). References to specific examples, use of "i.e.," use of the word "invention," etc., are not meant to invoke exception (b) or otherwise restrict the scope of the recited claim terms. Other than situations where exception (b) applies, nothing contained in this document should be considered a disclaimer or disavowal of claim scope.

The subject matter recited in the claims is not coextensive with and should not be interpreted to be coextensive with any embodiment, feature, or combination of features described or illustrated in this document. This is true even if only a single embodiment of the feature or combination of features is illustrated and described in this document.

INCORPORATION BY REFERENCE

The entire content of each of the documents listed below are incorporated by reference into this document. If the same term is used in both this document and one or more of the incorporated documents, then it should be interpreted to have the broadest meaning imparted by any one or combination of these sources unless the term has been explicitly defined to have a different meaning in this document. If there is an inconsistency between any of the following documents and this document, then this document shall govern. The incorporated subject matter should not be used to limit or narrow the scope of the explicitly recited or depicted subject matter.

U.S. Prov. App. No. 62/453,495, titled "Dyed Non-Hexavalent Chromium Conversion Coating," filed on 1 Feb. 2017 (attached hereto).

U.S. Prov. App. No. 62/588,129, titled "Dyed Trivalent Chromium Conversion Coatings," filed on 17 Nov. 2017 (attached hereto).

U.S. patent application Ser. No. 16/732,101, titled "Dyed Trivalent Chromium Conversion Coatings and Methods of Using Same," filed on 31 Dec. 2019, published on 7 May 2020.

U.S. Pat. No. 10,533,254, titled "Dyed Trivalent Chromium Conversion Coatings and Methods of Using Same," issued on 14 Jan. 2020.

U.S. patent application Ser. No. 16/552,996, titled "pH Stable Trivalent Chromium Coating Solutions," filed on 27 Aug. 2019. published 19 Dec. 2019.

U.S. Pat. No. 10,400,338, titled "pH Stable Trivalent Chromium Coating Solutions,", issued 3 Sep. 2019.

U.S. Pat. No. 8,486,203 (application. Ser. No. 12/706,360), titled "Conversion Coating and Anodizing Sealer with No Chromium," filed on 16 Feb. 2010, issued on 26 Jun. 2013.

U.S. Pat. No. 6,375,726 (application. Ser. No. 09/702,225), titled "Corrosion Resistant Coatings for Aluminum and Aluminum Alloys," filed on 31 Oct. 2000, issued on 23 Apr. 2002.

U.S. Pat. No. 6,511,532 (application. Ser. No. 10/012,982), titled "Post-Treatment for Anodized Aluminum," filed on 6 Nov. 2001, issued on 28 Jan. 2003.

U.S. Pat. No. 6,521,029 (application. Ser. No. 10/116,844), titled "Pretreatment for Aluminum and Aluminum Alloys," filed on 5 Apr. 2002, issued on 18 Feb. 2003.

U.S. Pat. No. 6,527,841 (application. Ser. No. 10/012,981), titled "Post-Treatment for Metal Coated Substrates," filed on 6 Nov. 2001, issued on 4 Mar. 2003.

U.S. Pat. No. 6,669,764 (application. Ser. No. 10/351,752), titled "Pretreatment for Aluminum and Aluminum Alloys," filed on 23 Jan. 2003, issued on 30 Dec. 2003.

U.S. Pat. No. 7,018,486 (application. Ser. No. 10/187,179), titled "Corrosion Resistant Trivalent Chromium Phosphated Chemical Conversion Coatings," filed on 27 Jun. 2002, issued on 28 Mar. 2006.

The portions of CN 102888138A, titled "Low-temperature anti-corrosion protective agent for surfaces of automobile parts," disclosing and describing corrosion inhibitor compounds, published on 23 Jan. 2013 (attached hereto).

The invention claimed is:

1. A conversion coating applicator comprising:

a first liner;

a hydrogel attached to the first liner; and a second liner removably attached to the hydrogel;

wherein the hydrogel comprises a trivalent chromium conversion coating solution comprising:

a trivalent chromium compound;

a zirconate compound; and a dye compound;

wherein the conversion coating solution is an aqueous solution.

2. The conversion coating applicator of claim 1 wherein the trivalent chromium compound comprises trivalent chromium sulfate.

3. The conversion coating applicator of claim 1 the hydrogel comprises an alginate hydrogel.

4. The conversion coating applicator of claim 1 the hydrogel comprises a sodium alginate hydrogel.

5. The conversion coating applicator of claim 1 wherein the zirconate compound comprises an alkali metal hexafluorozirconate compound.

6. The conversion coating applicator of claim 1 comprising approximately 0.2 g/liter to approximately 20 g/liter of the zirconate compound.

7. The conversion coating applicator of claim 1 wherein the dye compound comprises a metal complex azo dye.

8. The conversion coating applicator of claim 1 wherein the dye compound comprises a chromium complex azo dye.

9. The conversion coating applicator of claim 1 wherein the dye compound comprises a metal free azo dye.

10. The conversion coating applicator of claim 1 comprising approximately 0.01 wt % to approximately 2.0 wt % of the dye compound.

11. The conversion coating applicator of claim 1 comprising a phosphorous compound.

12. The conversion coating applicator of claim 1 wherein the trivalent chromium conversion coating satisfies the requirements of MIL-DTL-81706B Class 1A and Class 3 and/or MIL-DTL-5541F Class 1A and Class 3.

13. The conversion coating applicator of claim 1 comprising 2-mercaptobenzothiazole, 2-mercaptobenzimidazole, 2-mercaptobenzoxazole, and/or benzotriazole.

14. The conversion coating applicator of claim 1 wherein the trivalent chromium conversion coating solution has a pH of approximately 2.5 to approximately 4.5.

* * * * *